US011399586B2

(12) United States Patent
Blanc et al.

(10) Patent No.: US 11,399,586 B2
(45) Date of Patent: Aug. 2, 2022

(54) COSMETIC TREATMENT METHOD

(71) Applicant: L'OREAL, Paris (FR)

(72) Inventors: Jean-Baptiste Blanc, Chatenay Malabry (FR); Franck Giron, Lagny sur Marne (FR); Henri Samain, Bièvres (FR)

(73) Assignee: L'OREAL, Paris (FR)

( * ) Notice: Subject to any disclaimer, the term of this patent is extended or adjusted under 35 U.S.C. 154(b) by 442 days.

(21) Appl. No.: 15/747,928

(22) PCT Filed: Jul. 26, 2016

(86) PCT No.: PCT/EP2016/067845

§ 371 (c)(1),
(2) Date: Jan. 26, 2018

(87) PCT Pub. No.: WO2017/021241

PCT Pub. Date: Feb. 9, 2017

(65) Prior Publication Data

US 2018/0213871 A1 Aug. 2, 2018

(30) Foreign Application Priority Data

Jul. 31, 2015 (FR) ..... 1557361

(51) Int. Cl.

| | |
|---|---|
| ***A41G 5/00*** | (2006.01) |
| ***A41G 5/02*** | (2006.01) |
| ***B05B 5/16*** | (2006.01) |

(52) U.S. Cl.

CPC ..... *A41G 5/008* (2013.01); *A41G 5/0033* (2013.01); *A41G 5/02* (2013.01); *B05B 5/1683* (2013.01); *A41G 5/0086* (2013.01)

(58) Field of Classification Search

CPC .... A41G 5/0033; A41G 5/008; A41G 5/0086; A41G 5/00

(Continued)

(56) References Cited

U.S. PATENT DOCUMENTS 3,713,454 A * 1/1973 Tsukisaka ..... A41G 5/0013 132/212
3,794,933 A * 2/1974 Moorhead ..... A41G 3/0066 132/201

(Continued)

FOREIGN PATENT DOCUMENTS

CN 101026974 A 8/2007
CN 101132712 A 2/2008

(Continued)

OTHER PUBLICATIONS

ASABE S572.1 Droplet Size Classification; https://cdn2.hubspot.net/hub/95784/file-32015844-pdf/docs/asabe_s572.1_droplet_size_classification.pdf (Year: 2013).*

(Continued)

*Primary Examiner* — Rachel R Steitz
(74) *Attorney, Agent, or Firm* — Ronald M. Kachmarik; Cooper Legal Group LLC

(57) ABSTRACT

A cosmetic treatment method. The method includes creating, on a region of the keratin materials to be treated, a set of adhesive areas and of non-adhesive areas extending between the adhesive areas. The method includes electrostatically projecting fibres onto the region.

15 Claims, 1 Drawing Sheet

Figure 1:
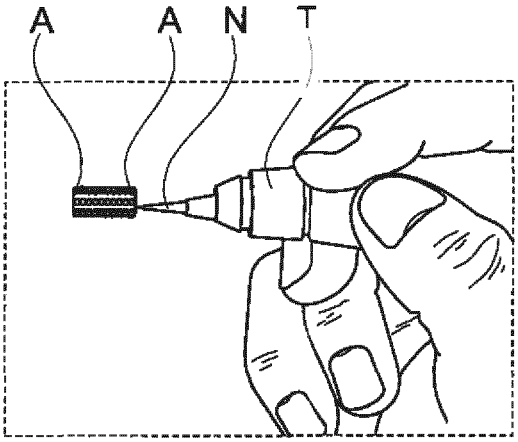

(58) Field of Classification Search
USPC ..... 132/201
See application file for complete search history.

(56) References Cited

U.S. PATENT DOCUMENTS

| | | | | |
|---|---|---|---|---|
| 6,168,781 | B1 * | 1/2001 | Ukaji | B05B 7/1413 239/143 |
| 6,732,743 | B1 * | 5/2004 | Bouix | A45D 40/0087 132/200 |
| 2004/0237987 | A1 * | 12/2004 | Gold | A41G 5/0033 132/201 |
| 2004/0262340 | A1 * | 12/2004 | Kress | A45D 33/02 222/633 |
| 2005/0265945 | A1 * | 12/2005 | Schnoll | A61K 8/985 424/70.14 |
| 2006/0081267 | A1 | 4/2006 | Kuptiz | |
| 2008/0041405 | A1 | 2/2008 | Kitsu et al. | |
| 2008/0060669 | A1 * | 3/2008 | Malvar | A45D 40/262 132/218 |
| 2008/0141467 | A1 * | 6/2008 | Wood | C23C 14/0015 8/405 |
| 2010/0218781 | A1 * | 9/2010 | McNamara | A45D 40/26 132/200 |
| 2010/0224126 | A1 * | 9/2010 | Kriman | B05C 19/002 118/621 |
| 2011/0089268 | A1 * | 4/2011 | Isaacs | A45D 19/00 239/690 |
| 2011/0195039 | A1 * | 8/2011 | Isaacs | A61K 8/027 424/70.9 |
| 2013/0333714 | A1 * | 12/2013 | Merszei | A41G 5/02 132/201 |
| 2014/0053863 | A1 * | 2/2014 | Chudzik | A45D 8/26 132/273 |
| 2014/0261514 | A1 | 9/2014 | Martins et al. | |
| 2016/0309821 | A1 * | 10/2016 | Knight | A61Q 5/00 |
| 2017/0035133 | A1 * | 2/2017 | Ismach | A61Q 1/10 |
| 2017/0311667 | A1 * | 11/2017 | Passariello | A61Q 5/00 |

FOREIGN PATENT DOCUMENTS

| | | | | |
|---|---|---|---|---|
| CN | 202415433 | | 9/2012 | |
| CN | 202415433 | U * | 9/2012 | |
| CN | 103027410 | A | 4/2013 | |
| EP | 2311333 | A1 | 4/2011 | |
| FR | 2957760 | A1 | 9/2011 | |
| JP | 56097214 | A * | 8/1981 | |
| JP | 02200806 | A | 8/1990 | |
| JP | 200105561 | A | 2/2001 | |
| JP | 2001055611 | | 2/2001 | |
| JP | 2001055611 | A * | 2/2001 | |
| JP | 2002302820 | A * | 10/2002 | |
| JP | 2002302820 | A | 10/2002 | |
| JP | 2004536928 | | 12/2004 | |
| JP | 2007332507 | A | 12/2007 | |
| JP | 2012112090 | A | 6/2012 | |
| KR | 1020090040112 | | 4/2009 | |
| WO | 2003011066 | A1 | 2/2003 | |
| WO | 2004023910 | A1 | 3/2004 | |
| WO | 2004055081 | A2 | 7/2004 | |
| WO | 2013015759 | A1 | 1/2013 | |
| WO | 2015091513 | A1 | 6/2015 | |
| WO | WO-2015095816 | A1 * | 6/2015 | A41G 5/0033 |

OTHER PUBLICATIONS

Diameter of a Human Hair, https://web.archive.org/web/20141106141313/https://hypertextbook.com/facts/1999/BrianLey.shtml (Year: 2014).*

Corresponding Korean Appl., Korean Office action, Appl. No. 10-2018-7002913, dated Feb. 12, 2019.

Corresponding Chinese Appl., Chinese Office action, Appl. No. 107920611, dated Dec. 17, 2018.

Corresponding Japanese Appl., Japanese Office action, Appl. No. 2018-504854, dated Apr. 1, 2019.

Corresponding Japanese Appl., Japanese Office action, Appl. No. 2018-504857, dated Apr. 1, 2019.

Corresponding International application, application No. PCT/EP2016/067845 International Search Report dated Aug. 30, 2016, 3 pages.

Chinese Office Action from Corresponding Chinese Application No. 201680045122.X, dated Jun. 24, 2021.

* cited by examiner

COSMETIC TREATMENT METHOD

The present invention relates to methods for the cosmetic treatment of human keratin materials and more particularly the skin.

Today, various techniques exist for masking or correcting alopecia:

- hair implants that require surgical procedures,
- hairpieces or wigs,
- "pepper shaker" systems that add bulk to the hairs still present in the thinning regions in order to make them more visible,
- colouring the skin by application of a conventional makeup or colouring product, or more invasively and permanently such as tattooing,
- the application of free fibres or fibres constituting a gel-type formula.

Apart from the invasive, expensive, surgical procedure that is difficult to put right if it is done poorly, it is difficult to have a makeup for alopecia that is undetectable both close up and from afar, that is to say that accurately reproduces the implantation and the density of human hair.

Wigs and hairpieces have certain advantages but lead to a fear of displacement in the course of the day. Furthermore, they are thought of as a prosthesis, which has a negative and off-putting impact. In addition, they are not suitable for most alopecias, especially when the scalp is partially covered with hair. Finally, wigs and hairpieces are not suitable for short haircuts. Thus, this solution does not meet with success.

Another approach consists in bonding individual fibres by electrostatic flocking. This solution consists in creating an electrostatic potential difference between a set of fibres and the area to be treated, precoated with an adhesive in the form of a continuous film. The fibres are then conveyed along the field lines and are planted in the adhesive.

WO03/011066 discloses a sticker for the application of hair.

The existing portable flocking tools bring a group of fibres to be flocked into the vicinity of a charged electrode. The electrode is found at the bottom of a box which contains the fibres and which offers, at its end opposite the electrode, an opening for releasing the fibres. The fibres are then projected by the electrostatic field onto the surface to be treated, where they are planted in the film of adhesive deposited on the skin, which is earthed. The flow of fibres and also their trajectories are not perfectly controlled. This results in a deposition of fibres randomly distributed over the area to be flocked. In order to obtain an aesthetically satisfactory result, the user must visually monitor the result and adjust the amount and also the distribution of the fibres by continuing or repeating the flocking operation. This operation is remarkably imprecise and insensitive, since too dense a flocking may be considered to be irreversible since the operation for removing the excess fibres proves to be tedious.

WO 2013/015759 discloses a portable electrostatic flocking device for treating a region of the body.

US 2011/0089268 A1 describes other examples of devices for dispensing a particulate material via an electrostatic route.

Furthermore, another problem relates to the containment of the fibres. The skin is known for being electrically conductive. Placing the area to be flocked at a given potential results in the whole of the skin being placed at this potential. The field lines that are established are thus not exclusively oriented towards the area to be flocked. This results in a production of fibres well beyond the desired area. In the case of an application in the vicinity of a sensitive area such as the eye contour area, a projection of fibres in an undesired direction must be prevented.

In order to prevent the fibres from spreading, containment cones exist, but the solution is not perfect, in particular with fibres that are difficult to flock. Operative fields exist to protect the sensitive areas of the body, but this solution does not prevent the dispersion of the fibres in the space.

Therefore there is a need, not fully met to date, for a simple method for controlling the implantation of fibres during an electrostatic flocking on human keratin materials, and more particularly the skin.

The invention aims to meet this need and achieves this by virtue of a cosmetic treatment method comprising the steps consisting in:

- creating, on a region of the keratin materials to be treated, a set of adhesive areas and of non-adhesive areas extending between the adhesive areas,
- electrostatically projecting fibres onto said region.

The invention is for example intended to treat the skin, especially the hair region, the eyebrows or the beard. The adhesive areas are formed by deposition of an adhesive composition on the keratin materials prior to the projection of the fibres.

An "adhesive composition" or "adhesive" denotes any material capable of withstanding being torn off, with or without a long-lasting adhesive strength. The fibres are, in the invention, retained on the keratin materials owing to the presence of the adhesive, and are not held in place by the mere fact of the electrostatic charges.

The invention makes it possible to substitute the continuous film of adhesive from the prior art with a network of adhesion points and thus to control more easily, by acting on the distribution of the points of this network, the implantation of the fibres and in particular the density of the flocking. The fact of depositing, in the invention, the adhesive composition by making non-adhesive areas between the adhesive areas indeed offers control over the density and the distribution of the fibres that remain attached to the keratin materials.

Compared to a film of adhesive covering the entire region, the comfort is significantly improved, in particular when use is made of high-strength adhesive compositions, that are generally rigid and therefore cannot easily follow the deformations of the skin.

Finally, makeup removal is easier and shampooing-type treatments are easier to carry out since they reach the scalp more easily.

The invention offers a satisfactory solution to the treatment of hair or eyebrow alopecia for beautification purposes, by "attaching" natural or synthetic fibres that mimic head hair or body hair on the scalp or eyebrow arch.

Furthermore, the invention makes it possible, for treating the scalp, to use adhesives of PSA (pressure-sensitive adhesive) type, without being faced with the problem of flattening of the hair over time.

Preferably, the adhesive areas are not connected, in particular with two adjacent areas separated from one another by a distance (measured from edge to edge) ranging from 30 microns to 3 mm, better still from 100 microns to 1 mm.

The size of the spaces between two adjacent adhesive areas, separated by a non-adhesive area, ranges for example from 30 μm to 3 mm, better still from 100 μm to 1 mm.

The adhesive areas may be in the form of a network, preferably a network of points, in particular a network of points from 30 microns to 3 mm in diameter. As a variant, the adhesive areas are in the form of a network of lines, or a network of lines and points, or a grid pattern. The network may be regular or irregular. An irregular network, in particular a random or pseudo-random network, is advantageous in that it makes it possible to impart a more natural appearance. In the case of a network of points, the latter may be of any shape, for example circular or non-circular. All the points of the network may be of the same shape, or as a variant within the network the shape and/or the size of the points changes, for example with a variation in size or shape as a function of the location within the network.

Preferably, the shape of the points is circular.

Also preferably, the network is irregular, with a non-constant spacing between two adjacent points.

The adhesive areas may be formed by any suitable means, for example being formed with the aid of an adhesive applicator arranged to deposit the adhesive on the skin at locations separated from one another.

The adhesive areas may be formed with the aid of a dispenser comprising at least one dispensing nozzle provided with a dispensing orifice through which the adhesive is dispensed.

In one preferred exemplary embodiment, the network of adhesion points has the following characteristics:

density from 4 to 700 points/$cm^2$, preferably 25 points/$cm^2$±20%, size of the points: from 300 μm to 3 mm in diameter, spacing, which depends on the density and the size: from 30 μm to 3 mm, and preferably from 100 μm to 1 mm, thickness of the points: from 3 μm to 1 mm.

The applicator may also transfer the adhesive by stamping.

In a variant, the adhesive is applied with the aid of a stencil. The adhesive may be applied by spraying, in particular through the above stencil.

The adhesive may be applied by bonding one or more adhesive articles to the skin, especially in the form of dots. In particular, the dots may be constituted of a double-sided adhesive film, coated on both sides with a removable protective film. The double-sided adhesive film is pre-cut into dots.

The density of the adhesive areas is preferably from 4 to 700 per $cm^2$, better still between 10 and 50 per $cm^2$, even better still between 20 and 30 per $cm^2$.

The adhesive is preferably chosen with an adhesive strength such that a fibre bonded to the keratin materials in one of said areas withstands a detachment force of 15 mN, better still of 20 mN. The adhesive may be a pressure-sensitive adhesive (PSA).

The fibres are preferably synthetic. As a variant, the fibres are natural, preferably being obtained from the hair of the person treated.

During the electrostatic projection of the fibres, the person is preferably brought to a non-zero potential, so as to increase the potential difference with the electrode placed in the vicinity of the fibres and to have an additional potential difference with the earth. In one exemplary embodiment of the invention, when the electrode in contact with the fibres is placed at a negative potential, the person is placed at positive potential, in particular greater than 1000 V, even better still greater than 10 000 V, or even greater than or equal to 30 kV. Such a potential reduces the amount of fibres likely to be deposited elsewhere than on the person treated.

Another subject of the invention is an assembly for the implementation of the method as defined above, comprising:

an adhesive composition to be applied to the keratin materials to be treated, fibres to be applied to said keratin materials, an applicator for applying the cosmetic composition by making non-adhesive areas between adhesive areas.

The composition, the fibres and/or the applicator are preferably contained before the first use in a same packaging device, such as a box, case, blister pack or sachet. Where appropriate, the flocking apparatus is also contained in the packaging device. This apparatus may comprise a handpiece containing the fibres and incorporating a first electrode. The apparatus may comprise a second electrode held or placed on the person to be treated.

Figure 4:
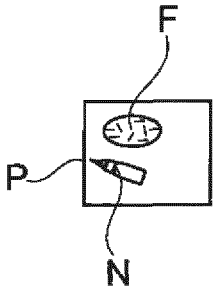
Figure 2:
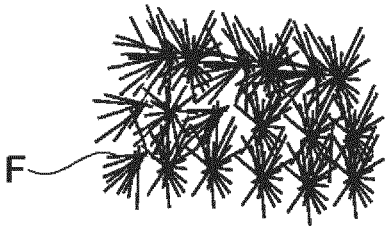
Figure 3A:
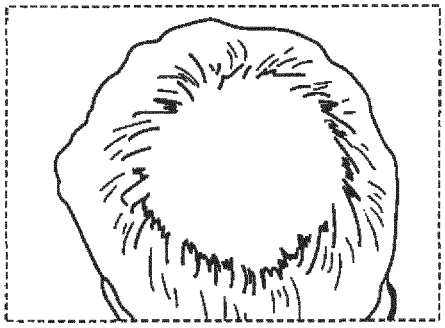
Figure 3B:
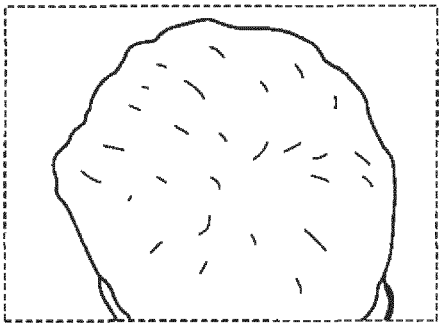

The invention may be better understood from reading the following detailed description of non-limiting exemplary embodiments thereof and from examining the appended drawing, in which:

FIG. 1 illustrates the application of adhesive composition onto the region to be treated, FIG. 2 represents the region from FIG. 1 after flocking, FIGS. 3A and 3B illustrate the treatment of the scalp, and FIG. 4 schematically represents a treatment assembly.

Fibres

The term "fibre" should be understood as meaning an object of length L and of diameter D such that L is greater than D and preferably very much greater than D, D being the diameter of the circle in which the cross section of the fibre is inscribed. In particular, the ratio L/D (or aspect ratio) is chosen in the range from 3.5 to 2500, preferably from 5 to 500 and better still from 5 to 150.

The fibres that can be used in the invention may be fibres of synthetic or natural, and mineral or organic origin. They may be short or long, individual or organized, for example braided, and hollow or solid. They may have any shape and may especially have a circular or polygonal (square, hexagonal or octagonal) cross section depending on the specific application envisaged. In particular, their ends may be blunted and/or smooth to prevent injury.

In particular, the fibres preferably have a length ranging from 0.5 mm to 20 mm.

Their cross section may be from 20 to 120 μm, better still 30 to 100 μm, even better still from 40 to 80 μm.

The weight or yarn count of fibres is often given in denier or decitex and represents the weight in grams per 9 km of yarn.

The fibres according to the invention have for example a yarn count chosen in the range from 0.1 to 100 denier, preferably from 1 to 70 denier and better still from 5 to 60 denier.

The fibres may be those used in the manufacture of textiles, and especially silk fibres, cotton fibres, wool fibres, flax fibres, cellulose fibres—especially extracted in particular from wood, from vegetables or from algae, rayon fibres, polyamide (Nylon®) fibres, viscose fibres, acetate fibres, especially rayon acetate fibres, acrylic polymer fibres, especially polymethyl methacrylate fibres or poly(2-hydroxyethyl methacrylate) fibres, polyolefin fibres and especially polyethylene or polypropylene fibres, glass fibres, silica fibres, carbon fibres, especially of carbon in graphite form, polytetrafluoroethylene (such as Teflon®) fibres, insoluble collagen fibres, polyester fibres, polyvinyl chloride fibres or polyvinylidene chloride fibres, polyvinyl alcohol fibres, polyacrylonitrile fibres, chitosan fibres, polyurethane fibres, polyethylene phthalate fibres, and fibres formed from a mixture of polymers such as those mentioned above, for instance polyamide/polyester fibres.

Preferably, the fibres are polyamide-6,6 fibres.

Furthermore, the fibres may be optionally surface-treated, optionally coated with a protective layer or layer intended to give them a colour.

Use may be made of flame-retardant acrylic fibres of "Kanekalon" brand.

The fibres are for example those sold under the reference Minke-props SKINTEX Flock ref. 590502.

It is possible to use identical fibres or as a variant a mixture of fibres that differ from one another in length, cross section, material, shape and/or cross section. The use of fibres of various lengths may impart greater naturalness. A mixture of colours too. In particular, it may be advantageous to mix grey and white or black and white fibres.

Adhesive Composition

The adhesive composition that is used to produce the adhesive areas is suitable for application to the skin, and for cosmetic use.

The adhesive composition comprises or is constituted of an adhesive material.

For the purposes of the present invention, the term "material" means a polymer or a polymeric system that may comprise one or more polymers of different nature. This adhesive material may be in the form of a polymer solution or a dispersion of polymer particles in a solvent. This adhesive material may in addition contain a plasticizer as defined above. This adhesive material should have a certain tackiness defined by its viscoelastic properties.

The adhesive materials according to the invention may be chosen from adhesives of "Pressure Sensitive Adhesives" type, for instance those cited in the "Handbook of Pressure Sensitive Adhesive Technology" 3rd edition, D. Satas.

The pressure-sensitive adhesive materials may be chosen from acrylic polymers, especially copolymers of acrylate and methacrylate, pressure-sensitive adhesives based on rubber or based on styrene copolymers, for example such as styrene-isoprene-styrene (SIS) and styrene-butadiene-styrene (SBS) copolymers.

They may also be urethane polymers, polyurethanes, silicones, such as Bio-PSAs, ethylene/vinyl acetate polymers, block copolymers based on styrene or natural rubbers, chloroprene, butadiene, isoprene, neoprene or the like.

As nonlimiting examples of pressure-sensitive adhesives based on rubbery polymers, mention may in particular be made of natural rubber (poly(cis-1,4-isoprene)), methyl methacrylate-isoprene graft copolymers, styrene-butadiene copolymers, butyl rubber, acrylonitrile-butadiene rubber, styrene-isoprene block copolymers, polybutadiene, ethylene-butylene block copolymers and polychloroprene.

Among the pressure-sensitive adhesives comprising polar acrylic polymers, mention may be made of block or statistical copolymers based on acrylic acid, alkyl acrylates and alkyl methacrylates, and also the copolymers of these acrylics with ethylene and vinyl acetate.

As other pressure-sensitive adhesives, mention may be made of copolymers of butyl acrylate, butyl methacrylate and acrylic acid, these copolymers being available commercially, for example under the brand RODERM 560 (Rohm and Haas).

An example of a pressure-sensitive adhesive that may be suitable is poly(2-ethylhexyl acrylate), for example the one available commercially under the brand GEL-TAC 100E (Advanced Polymer International), as an aqueous dispersion containing 40% solids of 15 micron adhesive acrylic microspheres.

Examples of acrylic polymers that may be suitable are available commercially under the brands EASTAREZ 2010, 2020 and 2050 (Eastman Chemical Co.), ACRONAL V210 (BASF), MOWILITH LDM 7255, REVACRYL 491 (Ciariant) and FLEXBOND 165 (Air Products).

Commercial examples of polymeric rubbers that may be suitable are known under the brands RICON 130 polybutadiene (Atofina Sartomer) and ISOLENE 40 polyisoprene (Elementis).

Examples of polyurethane-based adhesives that may be suitable are available under the brands SANCURE 2104 (Noveon) and VYLON UR 1400 (Toyobo Vylon).

Examples of vinyl acetate copolymers that may be suitable are available commercially under the brands PVP/VA 6-630 (International Specialty Products) and FLEXBOND 149 (Air Products).

Examples of vinyl alcohol/vinyl acetate copolymers are available commercially under the brands CELVOL 107 (Celanese) and ELVANOL 50-42 (DuPont).

Mention may also be made of the block or statistical copolymers comprising at least one monomer or a combination of monomers whose resulting polymer has a glass transition temperature lower than room temperature (25° C.), these monomers or combinations of monomers possibly being chosen from butadiene, ethylene, propylene, isoprene, isobutylene, a silicone, and mixtures thereof. Examples of such materials are block polymers of the type such as styrene-butadiene-styrene, styrene-(ethylene-butylene)-styrene and styrene-isoprene-styrene, for instance those sold under the trade names Kraton from Kraton or Vector from Dexco Polymers.

The adhesive materials according to the invention may also comprise tackifying resins, such as rosins or rosin derivatives such as hydrogenated rosins, rosin esters, hydrogenated rosin esters, terpenes, aliphatic or aromatic hydrocarbon-based resins, phenolic resins, styrene resins and coumarone-indene resins. Mention will also be made of the compounds such as shellac, sandarac gum, dammar resins, elemi gums, copal resins, benzoin, and gum mastic.

Mention may also be made of:

silicone resins, which are crosslinked polyorganosiloxane polymers.

The nomenclature of silicone resins is known under the name "MDTQ", the resin being described as a function of the various siloxane monomer units it comprises, each of the letters M, D, T and Q characterizing a type of unit.

Among these resins, mention may in particular be made of the siloxysilicate resins, which may be trimethyl siloxysilicates of formula $[(CH_3)_3XSiXO]_xX(SiO_{4/2})_y$ (MQ units) in which x and y are integers ranging from 50 to 80, the lipodispersible film-forming polymers in the form of non-aqueous dispersions of polymer particles, also known as NADs.

Use may be made, as non-aqueous dispersion of hydrophobic film-forming polymer, of dispersions of particles of a grafted ethylenic polymer, preferably an acrylic polymer, in a liquid oily phase, for example in the form of surface-stabilized particles dispersed in the liquid fatty phase.

The dispersion of surface-stabilized polymer particles can be manufactured as described in the document WO 04/055081.

Mention may also be made of the dispersions of $C_1$-$C_4$ alkyl (meth)acrylate polymer particles; stabilized by a stabilizing agent chosen from isobornyl (meth)acrylate polymers, as described in document WO 2015/091513.

As examples of preferred adhesives, mention may may be made of acrylic latices and soluble polymers such as sulfopolyesters.

Use may also be made of UV-reactive adhesives.

In examples, use is made of:

the Pros-Aide (acrylic latex) Cream Blend 331 Adhesive, the adhesive known under the reference AQ1350—Eastman Chemical (sulfopolyester soluble polymer).

The fibres F and the adhesive composition, and also the system N enabling the application of the adhesive composition, may be contained in a same packaging device P, as illustrated in FIG. 4.

EXAMPLES

In various examples, adhesion points are produced with the following characteristics:

330 μm in diameter with 70 μm spacing, i.e. a density of 625/cm$^2$,

660 μm in diameter with 140 μm spacing, i.e. a density of 150/cm$^2$, 1 mm in diameter with 1 mm spacing, i.e. a density of 25/cm$^2$, 1 mm in diameter with 100 μm spacing, i.e. a density of 90/cm$^2$, 2 mm in diameter with 1 mm spacing, i.e. a density of 9/cm$^2$.

In examples, the networks of adhesion points are created by dispensing one or more drops of a liquid adhesive composition, as illustrated for example in FIG. 1, or by deposition of drops of adhesive composition by transfer. Seen in FIG. 1 are the points of adhesive A positioned according to a network of points that are separate from one another. The application may take place with a tube T containing the adhesive composition, provided with a dispensing end piece N.

The application of adhesive may also be carried out with the aid of a volumetric adhesive dispenser, such as that known under the reference EFD Ultimus, or with a standard syringe-type end piece.

Represented in FIG. 2 is the region on which the adhesive composition was applied, after flocking.

The fibres F remain attached to the points where the adhesive was deposited.

Represented in FIGS. 3A and 3B is the scalp before and after treatment.

In this example, points of PROS-AIDE Cream Blend 331 adhesive are deposited with the aid of a multi-tip applicator on the scalp. Use is made of Minke-props (SKINTEX Flock ref. 590502) PA-6,6 fibres with the aid of a manual flocking apparatus such as the Microflocker from CAMPBELL COUTTS Ltd., equipped with a large-diameter flocking head, for example of 75 mm. The potential difference is bought to 45 kV.

The tests carried out demonstrate that, by means of the invention, the fibres randomly projected towards the area to be treated give a much more attractive result than when use is made of an adhesive applied continuously and uniformly.

The visual result obtained on the scalp is maintained over time without changing too much, whereas with a continuous adhesive the appearance of deposits is seen in certain cases.

Needless to say, the invention is not limited to the examples that have just been described. In particular it is possible to treat a region other than scalp.

The invention claimed is:

1. Cosmetic treatment method comprising:

creating, on a region of the skin to be treated, a set of adhesive areas and a set of non-adhesive areas extending between the adhesive areas, the adhesive areas being formed by deposition of an adhesive composition on said region of the skin, the adhesive areas not being connected, with two adjacent adhesive areas separated from one another by a distance ranging from 30 microns to 3 mm, subsequent to creating the set of adhesive areas, electrostatically projecting fibres onto said region.

2. Method according to claim 1, the adhesive areas being in the form of a network of points, each point having a diameter from 30 microns to 3 mm.

3. Method according to claim 2, the shape of each point being circular.

4. Method according to claim 3, the network being irregular.

5. Method according to claim 2, the network being irregular.

6. Method according to claim 1, the adhesive areas being formed with the aid of an adhesive applicator arranged to deposit the adhesive on the region of the skin at locations separated from one another.

7. Method according to claim 6, the adhesive applicator transferring the adhesive by stamping.

8. Method according to claim 1, the adhesive being applied with the aid of a stencil.

9. Method according to claim 1, the adhesive being applied by spraying.

10. Method according to claim 1, the adhesive being applied by bonding one or more adhesive articles to the region of the skin.

11. Method according to claim 1, the density of the adhesive areas being from 4 to 700 adhesive areas per cm$^2$.

12. Method according to claim 1, the adhesive being chosen with an adhesive strength such that a fibre bonded to the region of the skin by means of the adhesive in one of said areas withstands a detachment force of 15 m N.

13. Method according to claim 1, the adhesive being a pressure-sensitive adhesive.

14. Method according to claim 1, the fibres being synthetic.

15. Method according to claim 1, a treated person being brought to a non-zero potential during the electrostatic projection of the fibres, the non-zero potential being a potential greater than 1000 V.

* * * * *